United States Patent [19]

Krieger

[11] 4,095,616

[45] Jun. 20, 1978

[54] HYDRAULIC CONTROLLER

[75] Inventor: Karl Krieger, Wuppertal, Germany

[73] Assignee: Hermann Hemscheidt Maschinenfabrik, Wuppertal-Elberfeld, Germany

[21] Appl. No.: 744,101

[22] Filed: Nov. 22, 1976

[30] Foreign Application Priority Data

Nov. 25, 1975 Germany ..... 2552730

[51] Int. Cl.[2] ..... E21D 23/26; F15B 13/06; F16K 11/18

[52] U.S. Cl. ..... 137/596; 91/170 MP; 91/413; 137/625.11; 137/635

[58] Field of Search ..... 137/627, 625.11, 596, 137/636.4, 612.1, 635, 594; 251/111, 113, 297; 91/413, 170 MP

[56] References Cited

U.S. PATENT DOCUMENTS

| | | | |
|---|---|---|---|
| 2,499,318 | 2/1950 | Jungerhans | 137/635 |
| 2,609,207 | 9/1952 | Van Sickle | 137/635 |
| 3,986,701 | 11/1976 | Hopkins | 251/297 |

*Primary Examiner*—Martin P. Schwadron

*Assistant Examiner*—A. Michael Chambers

*Attorney, Agent, or Firm*—Berman, Aisenberg & Platt

[57] ABSTRACT

An hydraulic controller comprising: a casing; first and second inlets and a plurality of outlets associated with the casing; a flow-directing member rotatable in the casing; first and second passages extending through the flow-directing member, the flow-directing member being rotatable in the casing to each of a plurality of selected positions for directing liquid from the said inlets to selected ones of the outlets by way of said passages, each said first and second passage having an inlet end connected to a respective one of the first and second casing inlets, and having an outlet end connected to a selected one of the said several casing outlets according to the selected position of the said flow-directing member; first and second valves mounted in the flow-directing member and movable to open and close said first and second passages respectively; and locking means which operate in at least one of the said selected positions of the flow-directing member to prevent movement of the said first valve to a position for opening said first passage.

17 Claims, 4 Drawing Figures

HYDRAULIC CONTROLLER

This invention relates to a hydraulic controller which may be used, for example, to control the supply of pressure fluid to hydraulic ram cylinders of self-advancing mine-roof supports.

One type of hydraulic controller comprises a controller casing, a rotatably mounted master valve (i.e. flow-directing member) containing a check valve which can be pushed open by a tappet displaceable by movement of a manually operable control arm, and a spring-loaded tubular sealing plunger which by rotation of the rotary master valve can be selectively moved into sealing register with any one of a plurality of connecting bores concentrically disposed about the controller axis in a bottom plate of the controller casing and leading to the several ram cylinders, the underside of the rotary master valve body being formed with an annular recess providing communication between the non-selected connecting bores and a return line.

The controller described above serves to control the admission of high pressure hydraulic pressure fluid to the several ram cylinders from a central point. When the control arm is hingeably raised it will cause the rotary master valve to deliver the high pressure fluid through the check valve in the body of the master valve to a selected connecting bore and thence to the associated ram cylinder. This arrangement permits pressure to be supplied to all the ram cylinders in the support system in any desired sequential order. However, it has been found that it would be desirable to perform some operations, such as the retraction of ram cylinders, by fluid at a lower pressure acting on a small annular piston face. This is desirable firstly because the bearing supporting the thrust of a ram cylinder can generally sustain a greater load than the bearing which takes up the tension, and secondly because the speeds of retraction and advance of an actuator operated from a low pressure line will be slower and thus more suitable for some purposes because of the reduced rate of supply. The lower pressure could be obtained from the high pressure line through a reducing valve to give better metering for the controlling action. However, since conventional controllers are only suitable for controlling a restricted pressure range, the employment of a low pressure line in addition to a high pressure line would necessitate the provision of two separate controllers of the known type.

When advancing or controlling other functions of the selfadvancing system it may be advantageous if two functions, such as extending both the advancing ram cylinder and the roofbar cylinders, can be performed at the same time for the purpose of keeping the roofbar in sliding contact with the roof during advance of the supports by admitting low pressure into the roofbar cylinders. This would require the two controllers to be operated at the same time, a necessity calling for a considerable amount of skill.

It is therefore an aim of the present invention to provide a hydraulic controller which may be used for controlling the supply of a high pressure fluid source and a lower pressure fluid source to hydraulic rams, which controller has a pair of inlets and several outlets, and incorporates a safety device which in use of the controller will prevent one or more of the outlets from being connected to the source of high pressure fluid.

With this aim in view, the invention is directed to a hydraulic controller comprising a casing having a pair of inlets and a plurality of outlets, and a flow-directing member rotatable in the casing to each of a plurality of positions for directing liquid from the inlets to selected ones of the outlets by way of a pair of passages extending through the flow-directing member, each passage being connected at its inlet end to a respective one of the two casing inlets, and being connected at its outlet end to a selected one of the casing outlets according to the selected position of the flow-directing member, each passage being associated with a respective one of a pair of valves mounted in the flow-directing member and movable between passage-opening and passage-closing positions, the controller having locking means which operate in at least one of the selected positions of the flow-directing member to prevent movement of a first one of the valves to its passage-opening position.

In use of the controller, a source of high pressure hydraulic fluid will be connected to that one of the casing inlets which communicates with the passage containing the first valve, and a source of low pressure hydraulic fluid will be connected to the other casing inlet. In each selected position of the flow-directing member in which the locking means operate, it is not possible to open the first valve so that high pressure fluid cannot be supplied to the outlet of the passage which is closed by the first valve.

The control of the supply of high pressure and low pressure jointly by a single controller is of great advantage when the controller is used to control the mining apparatus described above, since it greatly simplifies control of roof supports comprising a large number of ram cylinders and hydraulic actuators.

It is preferred that each controller valve has a manually-controlled operating arm by means of which the valve can be opened, the two control arms being operable selectively either separately or simultaneously. This enables operation of two ram cylinders to be controlled simultaneously or individually at will.

The locking means may include a first locking pin slidable in the flow-directing member and biased towards a locking position from which it is forced to retreat during opening of the first valve, the arrangement being such that, when the flow-directing member is in a position in which the locking means operate, the pin is prevented from retreating from its locking position by a stop carried by the casing. The stop may be detachably carried by the casing, and the casing may be adapted to carry detachably a stop in each position with which the first locking pin is aligned in the said selected positions of the flow-directing member. By an appropriate disposition of the stops which can be easily exchanged, the controller can be adapted to select which operations can be performed exclusively with low pressure. Conveniently the said locking means also operate when the flow-directing member is in an intermediate position between adjacent ones of the said selected positions.

It is advantageous if the control arms are biased towards an inoperative position, and means are provided for retaining one or both of the operating arms in a valve-opening position after it has been released by an operator. This enables for instance the face conveyor to be held up against the coal face by the appropriate ram cylinder for an extended period of time.

An embodiment of hydraulic controller according to the invention will now be more particularly described by way of example and with reference to the drawings, in which.

Figure 1:
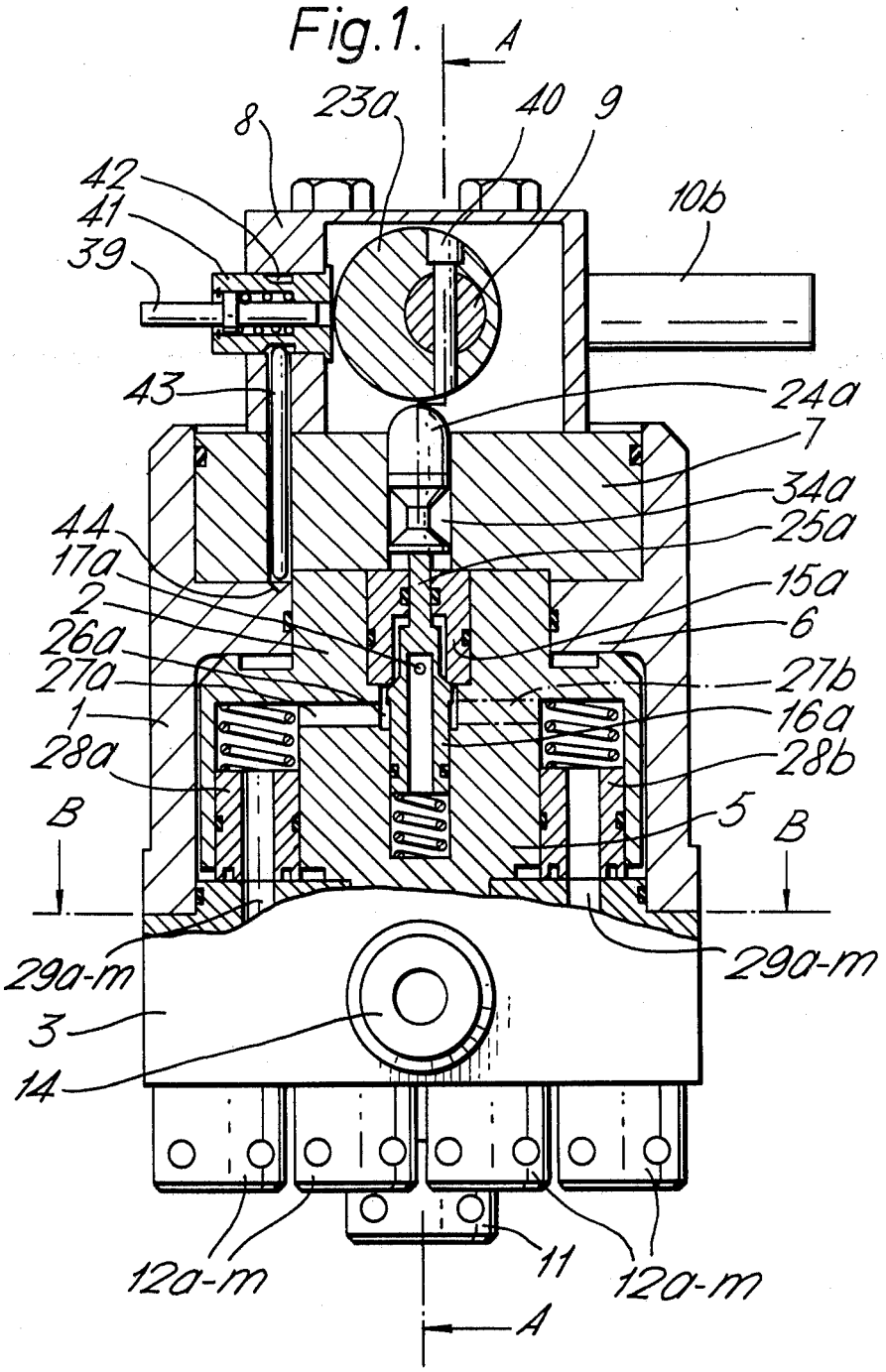
FIG. 1 is a part longitudinal section of a hydraulic controller, according to the invention, the lower portion containing the connections being represented in an external elevational view.
Figure 2:
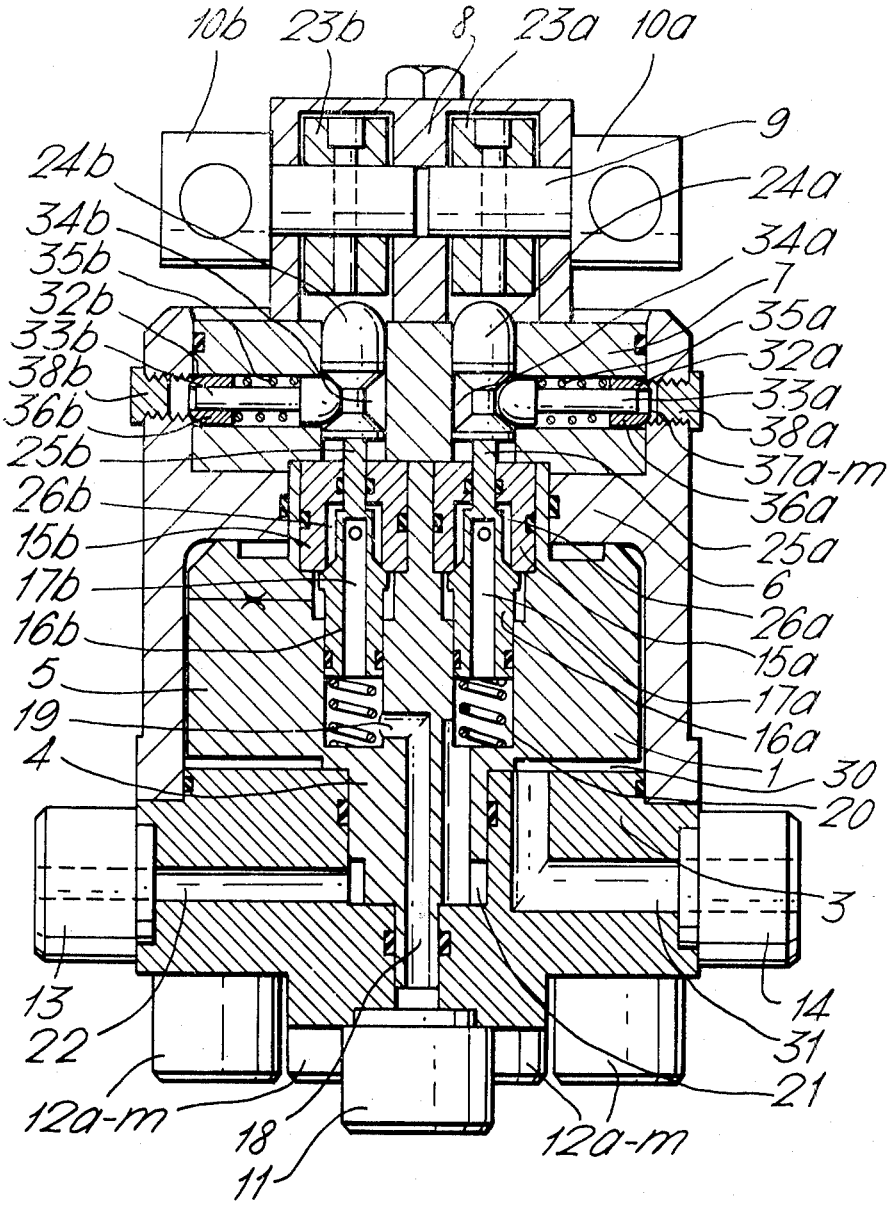
FIG. 2 is a longitudinal section of the controller in FIG. 1, but the section is taken on the line A—A.
Figure 3:
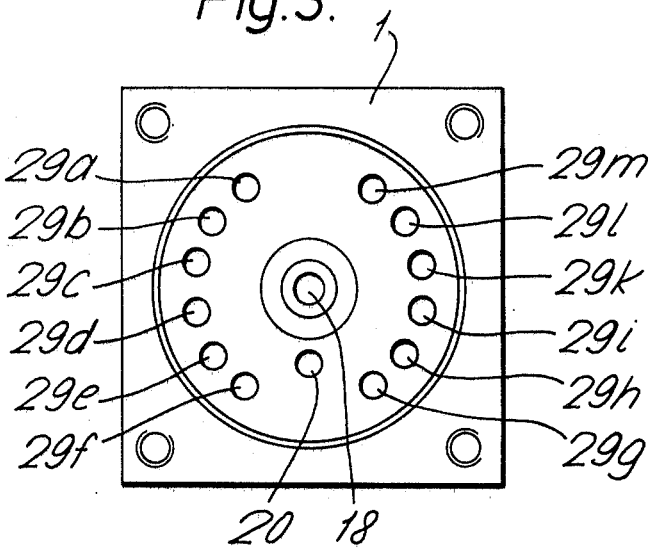
FIG. 3 is a cross section of the controller in FIG. 1, the section being taken on the line B—B.
Figure 4:
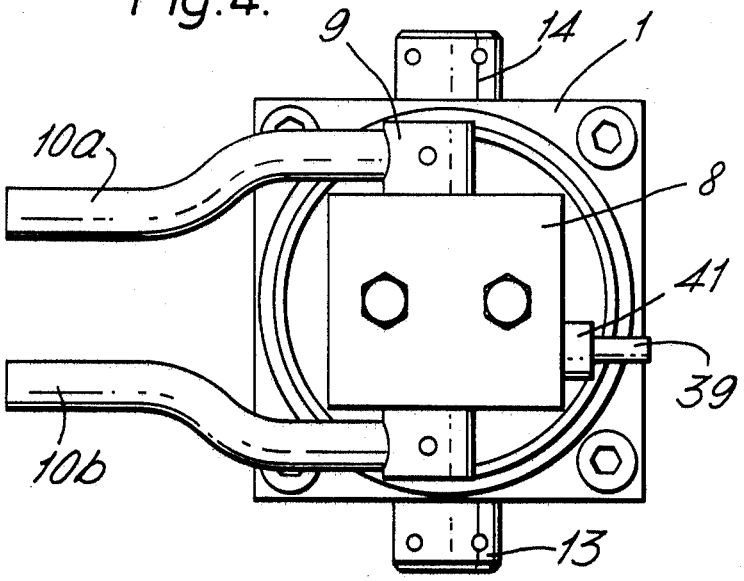
FIG. 4 is a view of the control unit from above.

The cylindrical interior of the external casing 1 of a hydraulic controller contains a rotatably mounted master valve 2 which serves to direct the supply of hydraulic fluid to appropriate ones of ram cylinders, not shown, of self-advancing supports in a mine. The master valve is thus a flow-directing member. The body of the master valve is formed with a cylindrical neck 4 which is rotatable in a bottom plate 3 of the controller casing, a main body part 5 which slidably bears on an annular internal flange 6 projecting into the interior of the controller casing 1, and an upper part 7, the parts 4, 5 and 7 being rotatable as a single unit. The part 7 is surmounted by a bearing head 8 rotatable with the valve 2 and containing two axially aligned parts of a divided shaft 9 fitted with two parallel manually operable control arms 10*a/b* which are operable separately or simultaneously. The axis of the shaft 9 is laterally offset from the axis of rotation of the valve 2.

A total of fifteen different supply and return pipes lead to the hydraulic controller, their connections 11, 12*a* to 12*m*, and 14 all being located on the bottom plate 3 to permit the flexible pipelines to be placed with the greatest economy in space. The connection 11 for a high pressure line is situated in the extension of the axis of rotation of the valve 2 on the underside of the bottom plate 3. The twelve connections 12*a* to 12*m* (12*j* is not used) for pipelines leading to the several ram cylinders are disposed concentrically about the connection 11. A low pressure line and the return line lead to connections 13 and 14 respectively on the side of the controller casing.

On diametrically opposite sides of its axis of rotation the lower part 5 of the rotary valve 2 contains two check valves 17*a/b* each comprising a valve seat 15*a/b* for a spring-loaded valve cone 16*a/b*. Each valve 17*a*, 17*b* serves to close a respective one of two passages through valve 2. The check valve 17*a* communicates with the low pressure connection 13 and the valve 17*b* with the high pressure connection 11. From connection 11 of the high pressure line a coaxial duct 18 leads to a short radial bore 19 beneath the high pressure check valve 17*b*. The low pressure check valve 17*a* communicates through an axial duct 20 and an annular groove 21 in the neck 4 of the rotary master valve 2 with a radial duct 22 leading to connection 13 of the low pressure line. Of the two control arms 10*a/b* which are affixed to the two halves of the shaft 9 in the bearing head 8 of the rotary valve 2, and which can be independently or jointly operated, one control arm 10*a* is associated with the low pressure check valve 17*a* and the other 10*b* with the high pressure check valve 17*b*. In order to open the check valves 17*a/b* the control arms 10*a/b* must be pivoted from the horizontal into the vertical. This causes eccentric members 23*a/b* mounted on the corresponding halves of the shaft 9 to depress thrust members 24*a/b* located coaxially with the check valves 17*a/b* and adapted to co-operate with tappets 25*a/b* which push the check valves 16*a/b* off their seats 15*a/b*. The hydraulic fluid in the high and low pressure lines will then flow separately through the annular valve chambers 26*a/b* and transverse ducts 27*a/b* to spring-loaded slidable tubular plungers 28*a/b* located on diametrically opposite sides of part 7 of the rotary valve 2. In any selected control position of the rotary master valve 2 these tubular plungers will be pressed into sealing contact with the end faces surrounding bores 29*a* to *m* which lead to a pair of the connections 12*a* to *m* on diametrically opposite sides of the master valve axis, thus providing a path for the hydraulic high and low pressure fluids to flow through the selected ones of connections 12*a* to *m* to the respective ram cylinders. The bores 29*a* to *m* which are not selected are connected by an annular channel 30 under the body of the rotary valve 2 and through an angle duct 31 in the bottom plate 3 of the casing 1 to the connection 14 of the fluid return line.

In the described arrangement the master valve 2 can be turned into any desired position of control and each of the twelve connecting bores 29*a* to *m* can be connected to the outlet ends of the two passages through the valve 2 connected to the high pressure and low pressure supply. In order to arrange that for functional or constructional reasons some connecting bores 29*l* to *m* can be supplied only with low pressure and never with high pressure, the upper portion 7 of the rotary valve 2, in radial bores 32*a/b*, contains radially slidable locking pins 33*a/b* of different lengths in respect of each check valve 17*a/b*.

When the check valves 17*a/b* are closed the inner convex heads of the locking pins 33*a/b* engage trapeze-section peripheral grooves 34*a/b* in the thrust members 24*a/b*. The locking pins are biased by compression springs 35*a/b* supported by sleeves 36*a/b* embracing the smooth stem of the locking pins 33*a/b* which in turn have conically tapered outer ends. In each selectable control position these sleeves snap into engagement with holes 37*a* to *m* provided in the casing 1 at equidistant peripheral intervals. The angular disposition of the holes 37*a* to *m* agrees with the angular disposition of the connecting bores 29*a* to *m*. Into the outer holes 37*a* to *m*, there are inserted, from the outside, locking screws 38*a/b* of different lengths, longer locking screws 38*a* which serve as stops being screwed into those ones of holes 37*a* to *m* which are associated with connecting bores 29*a* to *m* that are to be supplied only with low pressure fluid, whereas shorter screws 38*b* are screwed into those ones of holes 37*a* to *m* which are associated with connecting holes 29*a* to *m* that are to be supplied selectively with high pressure or with low pressure fluid. The holes 37*a* to 37*m* are thus in part occupied by locking screws, so that they form recesses into which ends of the locking pins may move. The recesses closed by the longer locking pins are of course shallower than the other recesses closed by the shorter pins. The length of the locking pins 33*a/b* which are displaceable radially outwards against the locking screws 38*a/b* is appropriately chosen. The locking pin 33*a* associated with the low pressure check valve 17*a* is shorter than the locking pin 33*b* associated with the high pressurecheck valve 17*b* and the length of both locking pins 33*a/b* is also so chosen that the thrust pins 24*a/b* cannot be displaced to open the check valves whilst the rotary master valve 2 is in an intermediate position between two selectable operating positions which are determined by the positions of the connecting bores 29*a* to *m*. If the valve 2 is turned into a wrong position, then the long locking pin 33*b* which is associated with the high pressure side will face a stop comprised by a long locking screw 38*a* associated with the low pressure side, and the thrust pin 24*b* cannot then be displaced for opening valve 17*b*. The control arm 10*b* will therefore be locked.

The pin 33*a* only serves as a locking pin in intermediate positions of the valve 2, in which case the end of pin 33*a* engages the casing which forms an abutment. The screws 38*b* do not prevent either valve from being opened, and thus serve mainly as dust caps.

The several connections to the ram cylinders are identified on the casing by suitable symbols (not shown). Preferably the cylinders are connected to the hydraulic controller in the order in which they are required to function so that the appropriate connections are established in series. Pairs of cylinders which are to be simultaneously supplied one with high pressure and the other with low pressure are connected to the hydraulic controller at two of the connections 12*a* to *m* angularly separated by 180°. The control arms 10*a/b* are used to turn the valve 2 into its several operative positions and the click of the spring-loaded sleeves 36*a/b* into engagement with a pair of the holes 37*a* to *m* indicates that an operating position has been reached. For jointly opening the check valves 17*a/b* the control arms 10*a/b* are together hingeably raised from their horizontal off-position into their vertical on-position. The control arms 10*a/b* can also be individually operated in any desired order. Since the eccentric members 23*a/b* are in an unstable equilibrium position when the check valves are open, the control arms 10*a/b* will return into their off-positions of their own accord.

However, if a control arm 10*a* or 10*b* is required to remain in an on-position for any length of time it can be retained in this position by an arresting pin, such as the pin 39 located in the bearing head 8 of the rotary valve 2 at the level of the shaft 9, the arresting pin being slidably pushed into engagement with a bore 40 which extends through the axis of rotation of the shaft 9. A spring-loaded sleeve 41 surrounding the arresting pin 39 and containing a peripheral groove 42 is moved towards the eccentric shaft 9. A tappet 43 which engages this groove and which retreats into a recess 44 in the casing 1 when the sleeve 41 is depressed will then engage the end of the sleeve 41 and retain it in its inwardly displaced position. Renewed pressure releases the self-locking arrestor and allows it to return into its normal position.

I claim:

1. An hydraulic controller for controlling the flow of hydraulic fluid to and from hydraulic jacks, the controller comprising: a casing; first and second inlets in the casing adapted to be connected in use of the controller to separate sources of pressurised hydraulic fluid; a plurality of jack supply openings in the casing for connection in use of the controller to jack supply lines to serve for the supply of fluid to said jacks and to receive fluid from said jacks; a return line outlet in the casing for connection in use of the controller to a reservoir of hydraulic fluid; a flow-directing member rotatable in the casing; first and second passages extending through the flow-directing member, said first and second passages having inlet and outlet ends, said inlet ends communicating with said first and second casing inlets respectively, said first and second passages being out of communication with each other; first and second valve members mounted in the flow-directing member and movable to open and close respective ones of said first and second passages; valve operating means operable to open both of said valves simultaneously, the flow-directing member being movable between a plurality of selectively available positions in each of which the outlet ends of the first and second passages communicate with selected jack supply openings whilst other jack supply openings are connected to the return line outlet, the controller further comprising locking means which operate in at least one of said selectively available positions of the flow-directing member to prevent movement of the first valve to a position for opening said first passage, the locking means thus preventing fluid flow from the first inlet to at least one jack supply opening.

2. An hydraulic controller as claimed in claim 1, and further comprising a recess in the underside of said flow-directing member, said recess forming a chamber by way of which those jack supply openings which are not connected to the casing inlets are connected to said return line outlet.

3. An hydraulic controller as claimed in claim 1, in which the first casing inlet which communicates with said first passage is connected to a source of hydraulic fluid at a first pressure, and in which the second casing inlet is connected to a source of hydraulic fluid at a second and lower pressure.

4. An hydraulic controller as claimed in claim 1, in which said locking means comprise a first locking pin slidable in said flow-directing member and biased towards a locking position, guide means being provided to force said first locking pin to retreat during opening of said first valve, a stop being carried by said casing, said stop serving to prevent retreat of the first locking pin for opening of the first valve when said flow-directing member is in a said selected position in which said locking means operate.

5. An hydraulic controller as claimed in claim 4, in which said stop is detachably carried by the casing, and the casing is adapted to carry detachably a stop in each position with which the first locking pin is aligned in the said selected positions of the flow-directing member.

6. An hydraulic controller as claimed in claim 4, in which, when said flow-directing member is in an intermediate position between adjacent selected positions, the said first locking pin is prevented from moving from its locking position by means of said casing which forms an abutment limiting movement of the locking pin.

7. An hydrualic controller as claimed in claim 6, and further comprising a second locking pin which serves to prevent movement of the said second valve to its passage-opening position, said second locking pin being slidable in said flow-directing member and being biased towards a locking position, guide means being provided to force said second locking pin to retreat from its said locking position during opening of said second valve, the arrangement being such that when the flow-directing member is in an intermediate position between adjacent selected positions said second locking pin is prevented from moving from its locking position by means of said casing which forms an abutment limiting movement of said second locking pin.

8. An hydraulic controller as claimed in claim 7, and further comprising a bottom plate of said casing, the casing outlets being formed by bores extending through said bottom plate and having their inlet ends disposed in a circle around the axis of rotation of the flow-directing member, the flow-directing member carrying a pair of spring loaded tubular sealing plungers which are disposed diametrically opposite one another and which form the said outlet ends of the passages through the flow-directing member, each said plunger lying in sealing register with a selected casing outlet bore in any of the said selected positions of the flow-directing member.

9. An hydraulic controller as claimed in claim 7, in which said casing has a number of recesses disposed spaced apart around it and so positioned that in each said selected position of the flow-directing member each said locking pin is aligned with a said recess into which an end of the locking pin moves as its associated valve moves towards its passage-opening position.

10. An hydraulic controller as claimed in claim 9, in which, when the flow-directing member is in a said position in which the locking means operate, the first locking pin is aligned with a said recess which has a said stop forming an end wall of the recess, said stop being a member inserted to a limited extent into a bore of the casing.

11. An hydraulic controller as claimed in claim 10, in which the said recess having a stop for preventing movement of said first locking pin from its locking position is shallower than the or each other said recess not provided with such a stop.

12. An hydraulic controller as claimed in claim 7, and further comprising a pair of thrust members, and heads on each locking pin, each said head, when its associated pin is in its locking position, engaging in a recess in a respective one of said thrust members to prevent movement of such thrust members, said valve operating means comprising first and second valve-operating members, each thrust member being associated with a respective one of the valves and serving to operatively connect a respective valve-operating member with its associated valve.

13. An hydraulic controller as claimed in claim 12, wherein said recess in each said thrust member is comprised by an annular groove which defines said guide means and widens outwardly, said head of each locking pin which is to engage in a said groove being rounded, the arrangement being such the head of the pin is forced out of the groove when the thrust member moves to open its associated valve.

14. An hydraulic controller as claimed in claim 12, in which each said valve operating member comprises a manually operable control arm, the controller further comprising two shafts, and an eccentric member carried by each shaft, each said control arm being connected to a respective shaft, the eccentric members engaging respective ones of said thrust members, said control arms being movable selectively either individually and together.

15. An hydraulic controller as claimed in claim 12, in which means is provided for locking the valve-operating means associated with at least one said valve in a valve-opening position.

16. An hydraulic controller as claimed in claim 7, in which said second locking pin is free to move from its locking position in all of said selected positions of the flow-directing member.

17. An hydraulic controller as claimed in claim 16, in which said first locking pin is longer than said second locking pin.

* * * * *